US009752828B2

(12) United States Patent
Ruottu

(10) Patent No.: US 9,752,828 B2
(45) Date of Patent: Sep. 5, 2017

(54) CIRCULATING MASS DRYER AND METHOD FOR DRYING WET SLUDGE

(71) Applicant: Endev Oy, Kotka (FI)

(72) Inventor: Seppo Ruottu, Kotka (FI)

(73) Assignee: Endev Oy, Kotka (FI)

( * ) Notice: Subject to any disclaimer, the term of this patent is extended or adjusted under 35 U.S.C. 154(b) by 0 days.

(21) Appl. No.: 14/769,534

(22) PCT Filed: Feb. 21, 2014

(86) PCT No.: PCT/FI2014/050133
§ 371 (c)(1),
(2) Date: Aug. 21, 2015

(87) PCT Pub. No.: WO2014/128356
PCT Pub. Date: Aug. 28, 2014

(65) Prior Publication Data

US 2016/0003540 A1 Jan. 7, 2016

(30) Foreign Application Priority Data

Feb. 22, 2013 (FI) ..... 20135160

(51) Int. Cl.
*F26B 3/08* (2006.01)
*F26B 3/084* (2006.01)
(Continued)

(52) U.S. Cl.
CPC ..... *F26B 3/084* (2013.01); *F23G 5/04* (2013.01); *F23G 5/30* (2013.01); *F26B 3/08* (2013.01);
(Continued)

(58) Field of Classification Search
CPC .... F26B 3/00; F26B 3/08; F26B 17/00; F26B 17/10; F26B 17/14; F26B 23/00;
(Continued)

(56) References Cited

U.S. PATENT DOCUMENTS 3,512,340 A * 5/1970 Fischer ..... B01D 51/10 209/10
3,779,181 A 12/1973 Staffin et al.
(Continued)

FOREIGN PATENT DOCUMENTS

FI 105853 B 10/2000
FI 106242 B 12/2000
(Continued)

OTHER PUBLICATIONS

International Search Report for corresponding International Patent Application No. PCT/FI2014/050133 mailed Mar. 26, 2014.
(Continued)

*Primary Examiner* — Stephen M Gravini
(74) *Attorney, Agent, or Firm* — Merchant & Gould P.C.

(57) ABSTRACT

The invention relates to a circulating mass dryer for drying wet sludge. According to the invention, the circulating mass dryer includes two adjacent circulating mass systems in heat exchange communication with one another, wherein the first circulating mass system is a sludge drying side and the second circulating mass system is a heat releasing side, and the first and the second circulating mass system each comprises at least one elongated riser (3, 16), and the riser (3) of the first circulating mass system and the riser (16) of the second circulating mass system are adjacent in such a way that a common heat exchange surface is formed therebetween. In addition, the invention relates to a corresponding method.

21 Claims, 2 Drawing Sheets

Figure 1:
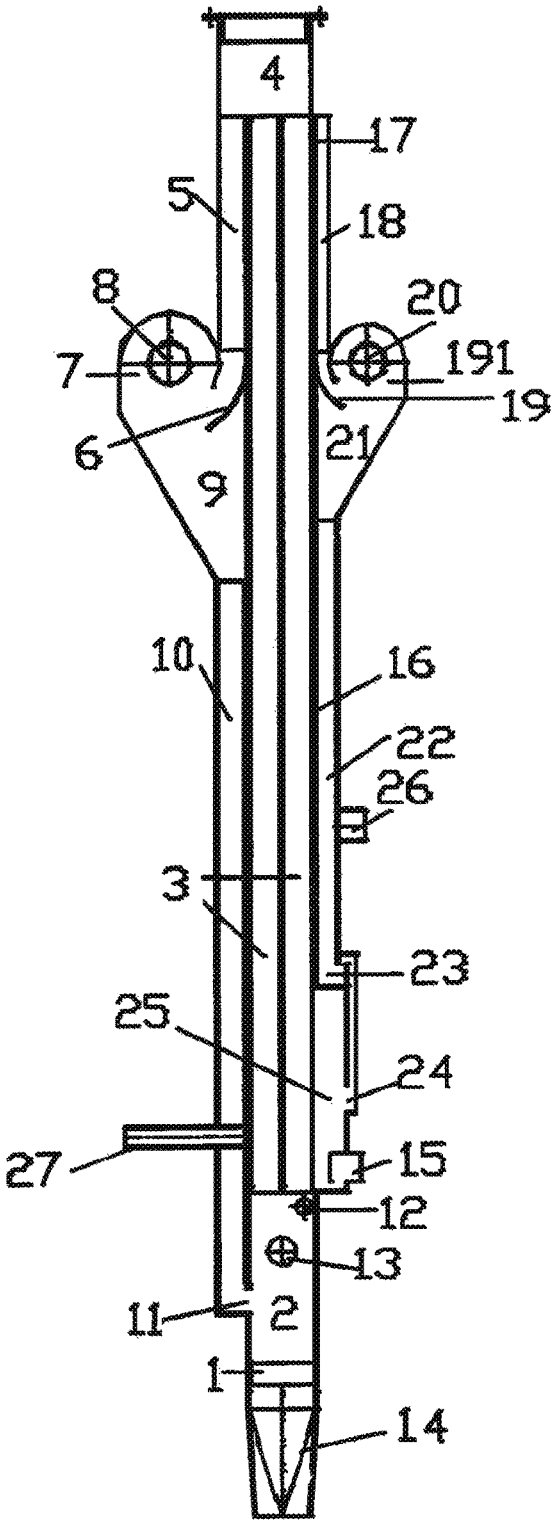

(51) Int. Cl.

| | |
|---|---|
| ***F26B 17/10*** | (2006.01) |
| ***F23G 5/04*** | (2006.01) |
| ***F26B 23/10*** | (2006.01) |
| ***F23G 5/30*** | (2006.01) |
| ***F26B 17/14*** | (2006.01) |

(52) U.S. Cl.
CPC ..... *F26B 17/10* (2013.01); *F26B 17/14* (2013.01); *F26B 23/10* (2013.01); *F26B 2200/02* (2013.01)

(58) Field of Classification Search
CPC ..... F26B 2200/10; F26B 5/04; F23G 7/00; F23G 5/04; C02F 1/00; C02F 1/44; F28F 9/00; F28F 9/007
USPC ..... 34/381, 477, 202, 218; 110/222, 224; 210/708, 767; 165/67, 185
See application file for complete search history.

(56) References Cited

U.S. PATENT DOCUMENTS 3,805,715 A 4/1974 Keller
3,961,587 A * 6/1976 Ozawa ..... F23G 5/14 110/160
4,215,151 A * 7/1980 Rios ..... A23F 5/043 209/28
4,366,000 A * 12/1982 Wadia ..... C04B 2/10 106/758
4,695,370 A * 9/1987 Galtier ..... C10G 11/18 208/113
5,638,609 A * 6/1997 Chandran ..... F23C 15/00 34/365
5,687,674 A * 11/1997 Johanntgen ..... F22D 1/36 110/234
5,765,293 A * 6/1998 St. Louis ..... F26B 1/00 210/667
5,809,664 A * 9/1998 Legros ..... F26B 3/088 159/4.01
5,881,475 A * 3/1999 Kishimoto ..... C02F 1/048 34/381
6,119,607 A * 9/2000 Guy ..... F23G 5/04 110/245
6,173,508 B1 * 1/2001 Strohmeyer, Jr. ..... F02C 6/18 34/578
8,371,041 B2 * 2/2013 Bonner ..... C10L 5/04 110/229
8,499,471 B2 * 8/2013 Coronella ..... F02C 3/28 15/26
8,607,469 B2 * 12/2013 Ueno ..... C04B 7/4446 110/224
9,234,701 B2 * 1/2016 Wada ..... B02C 13/282
9,273,904 B2 * 3/2016 Gasser ..... F23G 5/04
9,410,450 B2 * 8/2016 Naslund ..... F24D 10/00
2014/0048490 A1 * 2/2014 Roelen ..... C02F 1/442 210/703
2014/0296586 A1 * 10/2014 Chandran ..... C10J 3/482 585/240
2015/0047962 A1 * 2/2015 Trautmann ..... B01J 8/082 201/19
2015/0051428 A1 * 2/2015 Dayton ..... C10B 53/02 585/242
2016/0003540 A1 * 1/2016 Ruottu ..... F26B 3/08 34/363
2016/0145496 A1 * 5/2016 Sorensen ..... C10B 53/02 201/2.5

FOREIGN PATENT DOCUMENTS

FI CA 2936267 A1 * 8/2014 ..... F26B 3/08
FI WO 2014128356 A1 * 8/2014 ..... F26B 3/08
GB 1 102 760 A 2/1968
JP 2002-317180 A 10/2002
JP 2002317180 A * 10/2002
JP EP 2039663 B1 * 5/2013 ..... C04B 7/4446
KR 101354968 B1 * 1/2014 ..... C04B 7/4446
WO WO 2014/128357 8/2014

OTHER PUBLICATIONS

Extended European Search Report for corresponding European Patent Application No. 14754249.2 dated Nov. 2, 2016, 5 pgs.

* cited by examiner

CIRCULATING MASS DRYER AND METHOD FOR DRYING WET SLUDGE

This application is a National Stage Application of PCT/FI2014/050133, filed 21 Feb. 2014, which claims benefit of Serial No. 20135160, filed 22 Feb. 2013 in Finland and which applications are incorporated herein by reference. To the extent appropriate, a claim of priority is made to each of the above disclosed applications.

FIELD OF THE INVENTION

The invention relates to a circulating mass dryer for drying wet sludge as defined in the preamble of claim 1 and to a method for drying wet sludge as defined in the preamble of claim 12.

BACKGROUND OF THE INVENTION

Known from the prior art are different kinds of dryers for use in different kinds of processes. In addition, different kinds of dryers based on a fluidized bed and circulating mass technology are known. In terms of this invention, the closest prior art is represented by the fluidized bed and circulating mass dryers that recuperatively use hot water or water vapor as the heat source.

At the bottom of fluidized bed dryers, the vertical speed of the fluidization material is zero and the volume fraction of solid material typically ranges from 0.2 to 0.5. In the space above the fluidized bed, the volume fraction of solid material is typically <0.001, in which case the fluidization material flow exiting the dryer is small. In circulating mass dryers, the volume fraction of solid material in the fluidized bed typically ranges from 0.1 to 0.3 and in the area above the fluidized bed, such as in a riser, from 0.005 to 0.05. Due to the high solid material content in the riser, the circulating mass dryers are provided with a separator and a return channel, so that the solid material that exits the riser can be returned back to the fluidized bed.

In fluidized bed dryers based on recuperative heat delivery, the heat delivery surfaces must be fitted to the thick fluidized bed and so are subject to heavy wearing caused by the fluidization material. To prevent obstructions, the heat delivery surfaces must be packed loosely. To be able to fit a required amount of the heat delivery surface to the fluidized bed, its volume becomes large. For these reasons, the internal consumption of bubbling fluidized bed dryers is high. In addition, the heat delivery surfaces fitted to the fluidized bed impair the mixing of solid material in the fluidized bed and, especially when sludges are being dried, the risk of fouling and obstruction of the heat delivery surfaces is high. The problems of bubbling fluidized bed dryers also include a risk of fire and explosion, because the volume fraction of solid material above the fluidized bed is small, allowing the dry dust to form, in the presence of oxygen, an explosive mixture. Due to heavy wearing, a heat exchanger fitted to the fluidized bed requires a great deal of servicing, which limits the usability of the dryer.

To remedy the above-mentioned defects of bubbling fluidized bed dryers, circulating mass dryers in which the heat delivery surfaces are fitted above the fluidized bed have been developed. The first circulating mass dryer based on recuperative heat delivery is disclosed in Finnish patent FI 105853. The invention is characterized in that the riser of the circulating mass dryer fitted above the fluidized bed having the shape of a circular cylinder at the bottom of the dryer is formed by the tubes of a vertical tube heat exchanger having the shape of a circular cylinder, and that heat releasing water or steam is conveyed to the jacket side of that heat exchanger. In the invention of patent FI 105853, the rotationally symmetrical, multiple-opening cyclone of the circulating mass dryer is coaxially fitted above the heat exchanger in such a way that the tube located in the middle of the heat exchanger forms a return channel for the circulating mass. The dryer of patent FI 105853 and the circulating mass dryers based on recuperative heat delivery formed later on that basis remedy the above-mentioned defects of fluidized bed dryers, but not the problems that inevitably relate to the recuperative use of water or steam, the most significant ones being the expensive pressurized hot water or steam system, expensive pressurized structure and high internal consumption. The price of the dryer is further considerably raised if, for the production of hot water or steam, a separate boiler unit must be built for the dryer.

OBJECTIVE OF THE INVENTION

The objective of the invention is to disclose a novel drying solution for drying wet sludge. In addition, the objective of the invention is to disclose a novel circulating mass dryer.

SUMMARY OF THE INVENTION

The circulating mass dryer and method for drying wet sludge according to the invention are characterized by the features disclosed in the claims.

The invention is based on a circulating mass dryer for drying wet sludge. According to the invention, the circulating mass dryer includes two adjacent circulating mass systems in heat exchange communication with one another, preferably through a material-impermeable heat exchange surface, such as recuperatively through a material-impermeable heat exchange surface, and wherein the first circulating mass system is a sludge drying side and the second circulating mass system is a heat releasing side, and the first and the second circulating mass system each comprises at least one elongated riser, and the riser of the first circulating mass system and the riser of the second circulating mass system are adjacent in such a way that a common material-impermeable heat-exchange surface is formed therebetween.

In addition, the invention is based on a method for drying wet sludge. According to the invention, wet sludge is dried by means of a circulating mass dryer which includes two adjacent circulating mass systems in heat exchange communication with one another and wherein the first circulating mass system is a sludge drying side and the second circulating mass system is a heat releasing side and wherein the first and the second circulating mass system each comprises at least one elongated riser and the riser of the first circulating mass system and the riser of the second circulating mass system are adjacent in such a way that a common heat-exchange surface is formed therebetween, and wet sludge is fed to the first circulating mass system and heat releasing material is fed to the second circulating mass system.

In this connection, the circulating mass system of the dryer side is referred to as a first circulating mass system and the circulating mass system of the heat release side as a second circulating mass system.

In this connection, the riser may be any kind and shape of a tubular channel, pipe or the like, in which the material compositions can be conveyed upwards in the dryer in a closed space.

Sludge means in this connection any sludgy raw material formed by a liquid and a solid material.

The circulating mass dryer according to the invention is formed by two circulating mass systems in heat exchange communication preferably through a heat exchange surface, wherein the first circulating mass system carries out the drying process, and heat energy of a heat releasing material, e.g. heat energy of a gas, is transferred from the second circulating mass system through the heat exchange surface to the first circulating mass system that carries out the drying process.

In one embodiment, the first circulating mass system includes first fluidization material feeding means, e.g. a fluidization material feed connection, for feeding fluidization material to the fluidization chamber of the first circulating mass system, wet sludge feeding means, e.g. a sludge feed connection, for feeding sludge to the fluidization chamber, gas feeding means, e.g. a feed pipe, gas distribution grate and/or distribution nozzles, for feeding gas to the fluidization chamber, at least one elongated first riser preferably provided in the vertical direction, in which riser the wet sludge is fluidized, i.e. conveyed upwards in the fluidization space together with the fluidization material and gas while being dried, a first set of return channels for returning the mixture formed by solid fluidization material and dried sludge to the fluidization chamber and dried sludge discharging means, at least one pipe connection, by means of which the dried sludge which may also include fluidization material is discharged from the dryer.

In one method according to the invention, fluidization material is fed to the fluidization chamber of the first circulating mass system by the first fluidization material feeding means, wet sludge by the wet sludge feeding means and gas by the gas feeding means, wet sludge is fluidized upwards together with the fluidization material and gas while being dried in at least one elongated first riser, the mixture formed by solid fluidization material and dried sludge is returned by the first set of return channels to the fluidization chamber and dried sludge which may also include fluidization material is discharged by the dried sludge discharging means from the drier.

In one embodiment, the second circulating mass system includes second fluidization material feeding means, at least a feed connection, for feeding fluidization material to the fluidization chamber of the second circulating mass system, heat releasing material feeding means, e.g. a set of feed pipes, gas distribution grate and/or distribution nozzles, for feeding heat releasing material to the fluidization chamber of the second circulating mass system, at least one elongated second riser preferably provided in the vertical direction, in which riser the heat releasing material is fluidized upwards together with the fluidization material, a second set of return channels for returning the fluidization material to the fluidization chamber and fluidization material outlet means, at least a pipe connection, for discharging the fluidization material from the dryer.

In one method according to the invention, fluidization material is fed to the fluidization chamber of the second circulating mass system by the second fluidization material feeding means and heat releasing material by the heat releasing material feeding means, heat releasing material is fluidized upwards together with the fluidization material in at least one elongated second riser, the fluidization material is returned to the fluidization chamber by the second set of return channels and fluidization material is discharged as needed from the drier by the fluidization material outlet means.

In one embodiment, hot gas is used as the heat releasing material. In one embodiment, the temperature of the gas ranges from 500 to 900° C., in a preferred embodiment from 500 to 700° C. In one embodiment, the gas is fed through the heat exchanger to the dryer for adjusting the temperature to a suitable level.

In one embodiment, the heat source of the circulating mass dryer is gas which may include different types of particles, for example fouling particles, or condensing vapors, even to a significant degree. In one embodiment, flue gas is used as the gas.

The use of hot gas in the circulating mass dryer as heat releasing material presents many significant advantages. The mean temperature of the device functioning as the heat exchanger, and thus also the density of heat flow, may be multifold relative to what would be possible if the heat releasing material was water or water vapor. As the heat exchange number of the dryer side is of the same order of magnitude as that of the gas side, the required heat delivery surface for heat exchange may be, in the circulating mass dryer that uses hot gas, only 20-30% of the heat delivery surface of an equivalent dryer that uses water as the heat source. As the gas flow of the circulating mass dryer and thus its internal consumption is directly proportional to the circulating gas flow, the internal consumption is, in the gas-using circulating mass dryer, typically only 20-30% of the internal consumption of an equivalent dryer that uses water or steam as the heat source. The dryer according to the invention can be implemented as a non-overpressured structure so as to have lower manufacturing costs than an equivalent dryer that uses water or steam as the heat source. In addition, because the dryer according to the invention can be implemented as a non-overpressured structure, its cross-sectional surface may be rectangular, which is advantageous in terms of the manufacturing technique. The dryer need not be classified as a pressure vessel, so its use is not limited by regulations concerning pressure vessels. In addition, pressurized pipe systems or equipment required therefor are not necessary for the dryer, which reduces the overall costs of the dryer plant according to the invention even further. In many cases, it is also possible to avoid the expensive convection part of the boiler, as it is replaced by the heat exchanger of the circulating mass dryer. The energy price of gases that contain fouling particles and vapors is significantly lower than that of hot water or steam.

Despite of the advantages listed above, the use of gas as the heat source of the dryer has not been possible before because overheating of the structure or the fire or explosion risk relating to the use of hot gas have never been solved in a functional way. In addition, there has never before been a functional structural solution in order that gas containing a great deal of particles and/or condensing vapors could have been utilized.

The potential problems relating to the use of gas as the heat source have been solved in the circulating mass dryer according to the invention by circulating in the second circulating mass system a powdery fluidization material, a fluidization material most suitably having a particle size of 0.1-0.5 mm e.g. sand, on the side of the heat releasing flow in the circulating mass dryer. This arrangement provides many advantages. The maximum temperature of the temperature at the bottom of the second circulating mass system in the circulating mass dryer according to the invention operating as the heat exchanger may be precisely limited by the circulating mass flow of the second circulating mass system to a desired value irrespective of the temperature of the supplied gas by driving the circulating mass flow of the second circulating mass system as the setpoint value at the bottom of the circulating mass system of the heat releasing side in the dryer. The controlled circulating material flow of the second circulating mass system keeps the heat delivery surfaces of the heat releasing side, i.e. the gas side, in the dryer according to the invention clean, so that the heat delivery surfaces can be packed densely and the heat exchange remains good. The circulating mass flow of the second circulating mass system raises the thermal transmission coefficient of the heat exchange as compared to gas alone.

In one embodiment, the first circulating mass system includes a first separator part for separating the mixture formed by dried sludge and fluidization material from the rest of the suspension of gas and components vaporized and gasified in the drying, such as vaporized water, gaseous compounds or the like. In one embodiment, the first separator part comprises a separator arrangement including a substantially vertical separator inlet channel, a flow guide, a substantially horizontal separator chamber, a substantially horizontal central tube and a conical part of the separator. In one method according to the invention, the heat releasing material is separated from the fluidization material by means of a second separator part in the second circulating mass system. In one method according to the invention, the mixture formed by dried sludge and fluidization material is separated from the rest of the suspension by the first separator part in the first circulating mass system.

In one embodiment, the first circulating mass system includes separate discharge means for discharging the components removed from the sludge in the drying, such as vaporized and gasified components, from the first circulating mass system. In one embodiment, these discharge means are provided before the separator part. The discharge means may include e.g. a discharge pipe connection and a set of discharge pipes.

In one embodiment, the second circulating mass system includes a second separator part for separating the heat releasing material and fluidization material from one another. In one embodiment, the second separator part comprises a separator arrangement including a substantially vertical separator inlet channel, a flow guide, a substantially horizontal separator chamber and a substantially horizontal central tube and a conical part of the separator. In one method according to the invention, the heat releasing material is separated from the fluidization material by the second separator part in the second circulating mass system.

In one embodiment, the second circulating mass system including the assembly formed by the fluidization chamber, the second separator part and the second set of return channels comprises a regulating device fitted in the return channel for regulating the fluidization material flow of the return channel. In one method according to the invention, the fluidization material flow is regulated in the return channel of the second circulating mass system including the assembly formed by the fluidization chamber, the second separator part and the second set of return channels by means of the regulating device fitted in the return channel.

The separator arrangement according to the invention that is applicable in both the first and the second circulating mass system has many advantages. In the vertical downward directed separator inlet channel, the gravitational acceleration raises the speed of the solid material to be separated, which may be from 2 to 5 m/s higher than the speed of gas as calculated according to the free cross-sectional surface of the inlet channel. The separator arrangement according to the invention provides effective pre-separation, by virtue of which the single-stage separator provides effective separation even with suspensions having a high solid material content. The importance of this fact in circulating mass dryers is furthered even more because the volume fraction of the solid material in circulating mass dryers must be clearly greater in the riser, most suitably from 1 to 10%, than for example in circulating mass reactors designed for combustion, in the riser of which the volume fraction of the solid material is most suitably <1%. In conclusion, the following advantages of the separator system can be presented. By virtue of the effective pre-separation, the single-stage separator provides effective separation of the solid material even with thick suspensions. By virtue of the effective pre-separation, the degree of wearing in the structures of the separator is small. The separator does not include so-called shelf-type structures accumulating dry material that could be overheated and even cause a fire or explosion. The separator arrangement according to the invention provides a compact and inexpensive structure.

In one embodiment, the vertical free surface speed of the gas that functions as the heat releasing material is arranged to range from 0.5 to 3 m/s, more preferably from 1 to 2 m/s, in the fluidization chamber (25) of the second circulating mass system.

In one embodiment, the vertical free surface speed of the gas supplied to the first and/or the second separator part is arranged to range from 5 to 20 m/s, more preferably from 7 to 15 m/s, in the inlet channels.

The fluidization material used may be the same fluidization material in the first and the second circulating mass system. Alternatively, different fluidization materials may be used in the first and the second circulating mass system. The fluidization material used may be any fluidization material known per se and applicable for the purpose of use, e.g. sand, granular lime or other granular material, wherein the particle size of the fluidization material ranges from 0.1 to 1 mm.

In one embodiment, the first and the second circulating mass system are arranged to form a tube heat exchanger, wherein the first circulating mass system is provided on the tube side of the heat exchanger and the second circulating mass system is provided on the jacket side of the heat exchanger. In one alternative embodiment, the first and the second circulating mass system are arranged to form a tube heat exchanger, wherein the first circulating mass system is provided on the jacket side of the heat exchanger and the second circulating mass system is provided on the tube side of the heat exchanger.

Preferably, the circulating mass dryer according to the invention is used as a continuously operated apparatus.

In addition, the invention also relates to a circulating mass dryer including a circulating mass system for drying sludge and a heat releasing side wherein a heat releasing material is circulated, and a heat exchange surface therebetween for transferring heat from the heat releasing side to the drying of sludge. According to the invention, the heat releasing material used is a hot gas. Preferably, the temperature of the hot gas, for example a flue gas, may range from 300 to 1000° C. The circulating mass system for drying sludge may be similar to the first circulating mass system disclosed herein. In one embodiment, the heat releasing side may be arranged to surround the circulating mass system, preferably on the so-called jacket side. In one embodiment, the heat releasing side may be provided inside the circulating mass system, e.g. by tubes in which a hot gas flows. In one embodiment, the heat releasing side may be provided on the tube side and the circulating mass system on the jacket side.

The circulating mass dryer and method according to the invention may be used in the drying of different types of sludges. In one embodiment, sludges of a waste-water purification plant are being dried.

By virtue of the circulating mass dryer and method according to the invention, different types of sludges can be dried effectively and wet sludges can be turned into a useful product, e.g. for a combustion reactor.

LIST OF FIGURES

Figure 2:
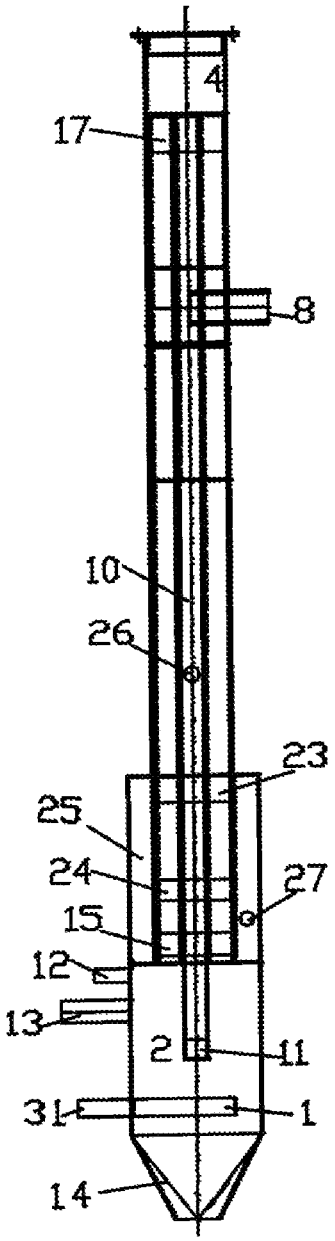
Figure 3:
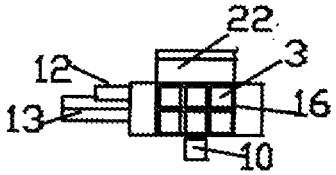

FIG. 1 illustrates one circulating mass dryer according to the invention as a sectional view from a first side, FIG. 2 illustrates the circulating mass dryer according to FIG. 1 as a sectional view from a second side which is perpendicular to the first side, and FIG. 3 illustrates the circulating mass dryer according to FIG. 1 as a horizontal sectional view.

DETAILED DESCRIPTION OF THE INVENTION

The invention will be described below by way of detailed embodiment examples with reference to the accompanying figures.

Example 1

FIG. 1, 2, 3 illustrate one embodiment of the dryer based on two circulating mass systems according to the invention. FIGS. 1 and 2 illustrate a side view of the dryer according to the invention in cross-section and FIG. 3 illustrates the dryer in a horizontal cross-section. The drying process is carried out in a first circulating mass system including a fluidization gas inlet connection (31) and a gas distribution grate (1) with distribution nozzles for distributing the fluidization gas to the fluidization chamber (2) of the first circulating mass system, to which fluidization chamber a separate fluidization material feed connection (12) and a feed connection (13) for the sludge material to be dried as well as a dried sludge outlet connection (14) are connected. From the fluidization chamber (2), the suspension formed by fluidization gas, sludge material to be dried and fluidization material rises in first risers (3), which are elongated vertically disposed tubular risers, to an overlying upper chamber (4).

The upper chamber (4) is connected to the separating cyclone of a first separator part for separating the mixture formed by dried sludge and fluidization material from the rest of the suspension with gas. The first separating cyclone includes a substantially vertical separator inlet channel (5), a flow guide (6), a substantially horizontal separator chamber (7), a substantially horizontal central tube (8) and a conical section (9) of the separator. The inlet end of the vertical, cross-sectionally rectangular separator inlet channel (5) of the separator cyclone is fitted in the upper chamber (4). The longer side of the horizontal cross-section of the separator inlet channel (5) is most suitably more than two times the length of the shorter side. To intensify the vortex that is formed in the substantially horizontal separator chamber (7), a flow guide (6) is fitted at the outlet end of the inlet channel (5). The advantage of this separator arrangement is that most of the solid material is gravitationally separated even before the separator chamber (7), whereto only dusty solid material is passed, by virtue of which the pressure loss and wearing of the separating cyclone are minimized. Said dust is concentrated on the wall of the separator chamber (7) by the effect of the vortex that is formed in the separator chamber (7) and the concentrated dust flow is gravitationally directed to the conical part (9) of the separator with the rest of the solid material. The gas that contains only a small amount of fine solid material exits through the horizontal central tube (8). The solid material directed to the conical part (9) is gravitationally directed to the upper end of a set of return channels (10,11) fitted at the bottom end of the cone. The mixture formed by solid fluidization material and dried sludge is returned to the fluidization chamber (2) of the first circulating mass system through the return channel (10) and the lower connection (11) of the return channel. The lower connection (11) of the return channel is fitted to connect the return channel (10) to the fluidization chamber (2).

What has been stated above concerning the operation of the circulating mass system of the dryer side, i.e. the first circulating mass system, is also mostly applicable to the heat releasing gas circulating mass system, i.e. the second circulating mass system. The second circulating mass system includes heat releasing gas feeding means (15). The gas feeding means (15) include a gas delivery connection and means for distributing the gas, e.g. a gas distribution grate and distribution nozzles through which the heat releasing gas is distributed to the fluidization chamber (25) of the second circulating mass system. The horizontal cross-sectional surface of the fluidization chamber (25) is so dimensioned that the vertical free surface speed of the gas as calculated according to the free cross-sectional surface most suitably ranges from 0.5 to 2 m/s. Most suitably, the means for distributing the gas are formed by pipes with spray orifices at the bottom. In addition, a fluidization material feed connection (26) and outlet connection (27) are connected to the fluidization chamber (25).

From the fluidization chamber (25) of the second circulating mass system, the suspension formed by heat releasing gas and fluidization material rises in a second elongated riser (16), in this connection a jacket surrounding the first risers (3), to the top part of the dryer. An opening (17) is fitted at the top part of the dryer for conveying the suspension formed by heat releasing gas and fluidization material to the separator cyclone of a second separator part for separating the heat releasing gas and fluidization material from one another. The second separator cyclone includes a substantially vertical separator inlet channel (18), a flow guide (19), a substantially horizontal separator chamber (191), a substantially horizontal central tube (20) and a conical part (21) of the separator. The horizontal section of the separator inlet channel (18) is rectangular. The free cross-sectional surface of the second riser, i.e. jacket (16), is so dimensioned that the vertical free surface speed of gas as calculated according to it most suitably ranges from 5 to 15 m/s, preferably as the gas arrives at the separator part. The longer side of the horizontal cross section of the separator inlet channel (18) is most suitably more than two times the length of the shorter side. To intensify the vortex formed in the substantially horizontal separator chamber (191), a flow guide (19) is fitted at the bottom end of the inlet channel (18). The free cross-sectional surface of the inlet channel (18) is so dimensioned that the speed of gas as calculated according to it most suitably ranges from 5 to 15 m/s. More than 99% of the solid fluidization material is thus gravitationally separated even before the separator chamber (191), whereto only a small portion of the solid fluidization material is passed. Said fine fluidization material is concentrated on the wall of the separator chamber (191) by the effect of the vortex that is formed in the separator chamber (191) and is gravitationally directed to the conical part (21) of the separator. The gas exits through the central tube (20). The fluidization material directed to the conical part (21) of the separator is gravitationally directed to the top end of the set of return channels (22,23,24) fitted at the bottom end of the cone. The fluidization material moves through a return channel (22) to a circulating mass regulating device (23) fitted at the bottom thereof and therefrom through a fluidization material opening (24) to the fluidization chamber (25) of the second circulating mass system.

The fluidization material flow that passes through the return channel (22) of the second circulating mass system is controlled and regulated by means of the regulating device (23) as a set point for the temperature of the fluidized bed which, depending on the material to be dried, most suitably ranges from 150 to 450° C., in the fluidization chamber (25). While the circulating fluidization material flow keeps the temperature of the fluidized bed at the desired set point, it also keeps the jacket side of the dryer clean. The fluidization material flow regulating device (23), such as an actuator, is most suitably pneumatic. From the regulating device (23), the fluidization material gravitationally moves in a non-packed state through the opening (24) to the fluidization chamber (25).

Although, in the example described above, the heat releasing gas circulating mass system is fitted on the jacket side of the dryer also operating as the heat exchanger, the solution according to the invention can be also carried out in such a way that the heat releasing gas circulating mass system is fitted on the tube side of the dryer.

In an embodiment of the dryer according to the invention which is preferred in terms of the flow, thermal and structural characteristics, the separator of the fluidization material used is a horizontal separator (5,6,7,8,9) and (18,19,191,20,21), wherein the most suitably cross-sectionally rectangular inlet channel (5) and (18) of the horizontal separator is directed substantially perpendicularly downwards for discharging the separated fluidization material from the separator, and the bottom of the substantially horizontal separator chamber is coupled to the top part of the return channel by the cone, and the horizontal cross-sectional shape of the circulating mass dryer is most suitably rectangular.

The circulating mass dryer and method according to the invention are applicable as different embodiments for use in carrying out the most diverse dryer solutions and for use in connection with drying of the most different kinds of sludges.

The invention is not limited merely to the examples described above; instead, many modifications are possible within the scope of the inventive idea defined by the claims.

The invention claimed is:

1. A circulating mass dryer for drying wet sludge, the dryer comprising:

a first circulating mass system and a second circulating mass system in heat exchange communication with one another, the first circulating mass system being a sludge drying side comprising:

a first elongated riser with a sludge inlet port, a first fluidization material port, and a gas feeding port; and a return channel in fluid communication with the first riser;

and the second circulating mass system being a heat releasing side comprising:

a second elongated riser with a second fluidization material port, and a heat releasing material feeding port;

the first elongated riser of the first circulating mass system and the second elongated riser of the second circulating mass system being adjacent and separated by a heat exchange surface therebetween.

2. The dryer according to claim 1, wherein the first circulating mass system further comprises a fluidization chamber and a dried sludge discharge port for discharging dried sludge from the dryer.

3. The dryer according to claim 1, wherein the first circulating mass system includes a first separator part for separating a mixture formed by dried sludge and fluidization material.

4. The dryer according to claim 3, wherein the first separator part comprises a separator arrangement including a substantially vertical separator inlet channel, a flow guide, a substantially horizontal separator chamber, a substantially horizontal central tube and a conical part of the first separator part.

5. The dryer according to claim 1, wherein the second circulating mass system further comprises a fluidization chamber and a fluidization material outlet for discharging the fluidization material from the dryer.

6. The dryer according to claim 1, wherein the second circulating mass system includes a second separator part for separating a heat releasing material and fluidization material from one another.

7. The dryer according to claim 6, wherein the second separator part comprises a separator arrangement including a substantially vertical separator inlet channel, a flow guide, a substantially horizontal separator chamber and a substantially horizontal central tube and a conical part of the second separator part.

8. The dryer according to claim 1, wherein the second circulating mass system further comprises a fluidization chamber, a second separator part, a second return channel, and a regulating device fitted in the return channel for regulating fluidization material flow in the return channel.

9. The dryer according to claim 1, wherein the heat releasing material feeding port is constructed to feed hot gas into the second elongated riser for use as a heat releasing material.

10. The dryer according to claim 9, wherein the hot gas is a flue gas.

11. The dryer according to claim 1, wherein the first and the second circulating mass system form a tubular heat exchanger, wherein the first circulating mass system is provided on a tube side of the heat exchanger and the second circulating mass system is provided on a jacket side of the heat exchanger.

12. A method for drying wet sludge in a circulating mass dryer comprising a first circulating mass system and a second circulating mass system in heat exchange communication with one another, wherein the first circulating mass system is a sludge drying side comprising a first elongated riser, a sludge inlet port, a first fluidization material port, and a gas feeding port, and a return channel in fluid communication with the first riser, wherein the second circulating mass system is a heat releasing side comprising a second elongated riser with a second fluidization material port, and a heat releasing material feeding port, and wherein the riser of the first circulating mass system and the riser of the second circulating mass system are adjacent in such a way that a common heat exchange surface is formed therebetween, the method comprising:

feeding wet sludge, a first fluidization material, and gas to the first circulating mass system; and feeding heat releasing material and a second fluidization material to the second circulating mass system.

13. The method according to claim 12, wherein the first fluidization material is fed through the first fluidization material port, the wet sludge is fed through the sludge inlet port and the gas is fed through the gas feeding port to a fluidization chamber of the first circulating mass system, the wet sludge is conveyed upwards together with the fluidization material and the gas while being dried in at least one elongated first riser, the first fluidization material and dried sludge are returned by the return channel to the first fluidization chamber and dried sludge is discharged through a dried sludge discharge port from the drier.

14. The method according to claim 12 further comprising separating a mixture formed by dried sludge and fluidization material by a first separator part in the first circulating mass system.

15. The method according to claim 12, wherein the second fluidization material is fed through the second fluidization material port and the heat releasing material is fed through the heat releasing material feeding port to a fluidization chamber of the second circulating mass system, the method further comprising fluidizing the heat releasing material upwards together with the fluidization material in the second elongated riser, and returning the second fluidization material by a second set of return channels to the second fluidization chamber and discharging the second fluidization material as needed through a fluidization material outlet from the drier.

16. The method according to claim 15, wherein the heat releasing material is separated from fluidization material by a second separator part in the second circulating mass system.

17. The method according to claim 12, further comprising regulating flow of the second fluidization material in a return channel of the second circulating mass system with a regulating device fitted in the return channel.

18. The method according to claim 12, wherein hot gas is used as the heat releasing material.

19. The method according to claim 18, wherein the hot gas used is a flue gas.

20. The method according to claim 12, wherein the heat releasing material comprises a gas having a vertical free surface speed from 0.5 to 2 m/s in the second fluidization chamber of the second circulating mass system.

21. The method according to claim 12, wherein each of the first and second circulating mass systems comprise a separator part, and wherein gas arriving at the separator part has a vertical free surface speed from 5 to 15 m/s.

* * * * *